US008456377B2

(12) United States Patent
Kyeong et al.

(10) Patent No.: US 8,456,377 B2
(45) Date of Patent: Jun. 4, 2013

(54) METHOD OF DISPOSING MULTIPLE ANTENNAS AND COMMUNICATION APPARATUS USING THE METHOD

(75) Inventors: Mun Geon Kyeong, Daejeon (KR); Woo Yong Lee, Daejeon (KR); Seung Joon Lee, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 392 days.

(21) Appl. No.: 12/939,739

(22) Filed: Nov. 4, 2010

(65) Prior Publication Data

US 2011/0102294 A1 May 5, 2011

(30) Foreign Application Priority Data

Apr. 19, 2010 (KR) ..... 10-2010-0035877

(51) Int. Cl.
*H01Q 21/00* (2006.01)

(52) U.S. Cl.
USPC ..... 343/893; 343/879

(58) Field of Classification Search
USPC ..... 343/893, 879; 370/254, 278, 334, 370/498; 375/259, 267
See application file for complete search history.

(56) References Cited

U.S. PATENT DOCUMENTS

| | | | | |
|---|---|---|---|---|
| 7,693,228 | B2 * | 4/2010 | Aldana et al. | 375/267 |
| 8,027,315 | B2 * | 9/2011 | Urquhart et al. | 370/334 |
| 8,116,241 | B2 * | 2/2012 | Shimizu et al. | 370/310 |

FOREIGN PATENT DOCUMENTS

| | | |
|---|---|---|
| JP | 2009-27539 | 2/2009 |
| KR | 1020050098896 | 10/2005 |

OTHER PUBLICATIONS

Bohagen, Frode et al., "Design of Optimal High-Rank Line-of-Sight MIMO Channels," IEEE Transactions on Wireless Communications, vol. 6(4):1420-1425 (2007).

Moraitis, Nektarios et al., "Indoor Channel Capacity Evaluation Utilizing ULA and URA Antennas in the Millimeter Wave Band," The 18th Annual IEEE International Symposium on Personal, Indoor and Mobile Radio Communications (PIMRC'07), pp. 1-5 (2007).

* cited by examiner

*Primary Examiner* — Hoang V Nguyen
(74) *Attorney, Agent, or Firm* — Nelson Mullins Riley & Scarborough LLP; EuiHoon Lee, Esq.

(57) ABSTRACT

Provided is an apparatus and method that may dispose multiple antennas positioned in each of terminals in such a way that respective arrangements of the multiple antennas of the terminals are parallel to each other even when the terminal is rotated, thereby increasing a channel capacity. A transmission apparatus using the multiple antennas may include a first antenna unit to be disposed parallel to an arrangement of multiple antennas of a receiver while facing the arrangement of the multiple antennas of the receiver, and a second antenna unit where a transmission antenna is additionally disposed so that an arrangement of multiple antennas of a transmitter is parallel to the arrangement of the multiple antennas of the receiver while facing the arrangement of the multiple antennas of the receiver, when the transmitter is rotated.

12 Claims, 10 Drawing Sheets

METHOD OF DISPOSING MULTIPLE ANTENNAS AND COMMUNICATION APPARATUS USING THE METHOD

CROSS-REFERENCE TO RELATED APPLICATIONS

This application claims the benefit of Korean Patent Application Nos. 10-2009-0106003, filed on Nov. 4, 2009, and 10-2010-0035877, filed on Apr. 19, 2010, in the Korean Intellectual Property Office, the disclosures of which are incorporated herein by reference.

BACKGROUND

1. Field of the Invention

Embodiments of the present invention relate to a communication technology using multiple antennas, and more particularly, to an arrangement of the multiple antennas in a channel where a Line-Of-Sight signal and a reflection signal are mainly provided.

2. Description of the Related Art

Multiple antennas may be mainly used in a wireless and mobile communication field. When using the multiple antennas, a plurality of transmission paths that are spatially separated from each other while using the same time and the same frequency, may be created. Accordingly, in a case of using the multiple antennas, a capacity of a transmittable signal may advantageously increase even using the same power.

Multi-path signals as signals used in a wireless Local Area Network (LAN) or a mobile communication may be reflected and/or scattered by an object while being transmitted. In this case, after being scattered, a signal may have a random phase unrelated to a phase of an input signal. In this regard, an environment where a large number of objects causing the signals to be scattered exist around a transmitter and a receiver may be referred to as a rich-scattering environment, and the rich-scattering environment may be an important condition for enabling a multi-antenna communication technology to have a high performance. As another condition for the high performance of the multi-antenna communication technology, a distance between each antenna in a multiple antennas respectively positioned in the transmitter and the receiver may need to be one half a wavelength of a transmitted signal. However, in the rich-scattering environment, a direction of the multiple antennas of the transmitter and the receiver may not affect a performance of the multiple-antenna communication technology.

All wireless channels may not have the rich-scattering environment. When a frequency of a signal significantly increases, that is, when a wavelength of a signal decreases, the signal may be less easily scattered. So that the signal is scattered, a size of an object may need to be significantly reduced to be less than the wavelength of the signal, otherwise when the wavelength of the signal is significantly reduced to be less than the size of the object, the object may only reflect the signal without scattering the signal.

In a case of a channel where a signal-scattering phenomenon does not occur, having the distance between the multiple antennas corresponding to one half the wavelength of the transmitted signal may not ensure the high performance of the multi-antenna communication technology. Also, the direction of each multiple antenna arrangement, which may affect the performance of the multiple-antenna communication technology, may be a significant problem.

Accordingly, in a case of the channel where the signal-scattering phenomenon does not occur, there is a desire for a method to determine the distance between each antenna in a multiple antennas that may ensure the high performance of the multi-antenna communication technology and a method to determine the direction of each arrangement of the multiple antennas affecting the high performance.

SUMMARY

According to an aspect of the present invention, there is provided a transmission apparatus, including: a first antenna unit to be disposed parallel to an arrangement of multiple antennas of a receiver while facing the arrangement of the multiple antennas of the receiver; and a second antenna unit where a transmission antenna is additionally disposed so that an arrangement of multiple antennas of a transmitter is parallel to the arrangement of the multiple antennas of the receiver while facing the arrangement of the multiple antennas of the receiver, when the transmitter is rotated.

According to an aspect of the present invention, there is provided a method of disposing multiple antennas which additionally disposes a transmission antenna based on a case where a transmitter is rotated, so that an arrangement of multiple antennas disposed in the transmitter is parallel to an arrangement of multiple antennas of a receiver while facing the arrangement of the multiple antennas of the receiver.

Additional aspects, features, and/or advantages of the invention will be set forth in part in the description which follows and, in part, will be apparent from the description, or may be learned by practice of the invention.

BRIEF DESCRIPTION OF THE DRAWINGS

These and/or other aspects, features, and advantages of the invention will become apparent and more readily appreciated from the following description of exemplary embodiments, taken in conjunction with the accompanying drawings of which.

DETAILED DESCRIPTION

Figure 1:
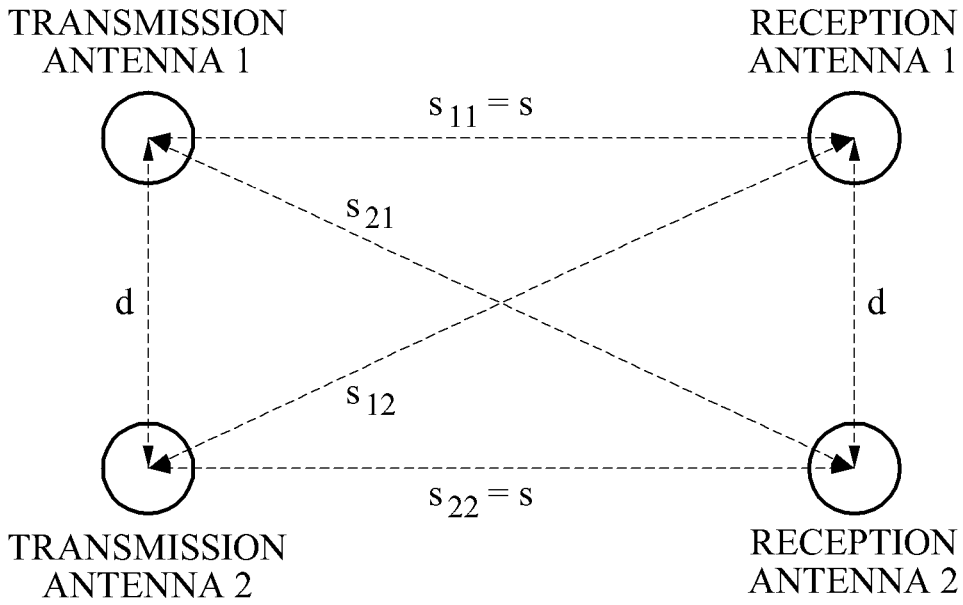
FIG. 1 is a diagram used for describing a Line-Of-Sight channel.

Reference will now be made in detail to exemplary embodiments of the present invention, examples of which are illustrated in the accompanying drawings, wherein like reference numerals refer to the like elements throughout. Exemplary embodiments are described below to explain the present invention by referring to the figures.

FIG. 1 is a diagram used for describing a Line-of-Sight channel.

In FIG. 1, a channel including two transmission antennas and two reception antennas and each having a Line-Of-Sight path with each other is illustrated.

Referring to FIG. 1, a transmission signal may be directly transmitted to a reception antenna without being reflected or scattered in the channel where only the Line-of-Sight path is present. In this case, it may be assumed that an arrangement of the two transmission antennas and an arrangement of the two reception antennas are parallel to each other while facing each other, each of a distance between transmission antennas 1 and 2 and a distance between reception antennas 1 and 2 is 'd', and a spacing between the transmission antenna and the reception antenna satisfies $s_{11}=s_{22}=s$, and $s_{12}=s_{21}$.

Figure 2:
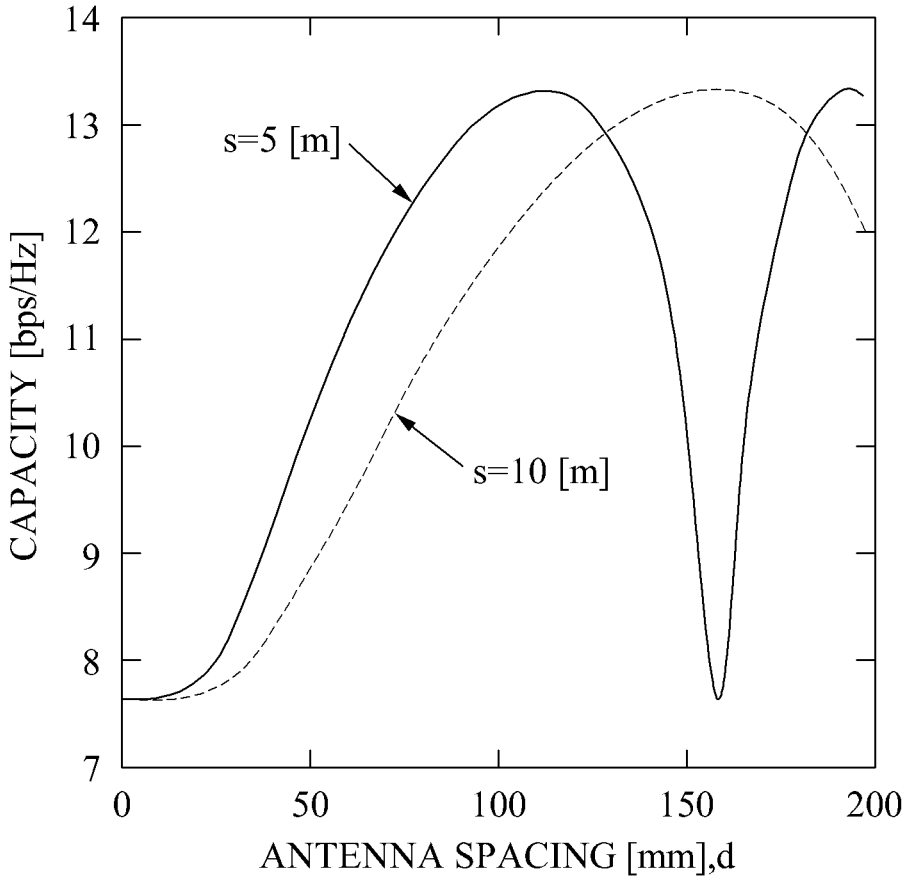
FIG. 2 is a graph illustrating a channel capacity varying depending on a distance between each antenna in a multiple antennas in the channel of FIG. 1.

FIG. 2 is a graph illustrating a channel capacity varying depending on a distance (d) between each antenna in a multiple antennas in the channel of FIG. 1.

In FIG. 2, the channel capacity varying depending on a distance (d) between each antenna in a multiple antennas where a distance between a transmitter and a receiver in the channel of FIG. 1 satisfies s=5 m, and satisfies s=10 m, is illustrated.

Referring to FIG. 2, so that the channel capacity is a maximum when the spacing s between the transmission antenna and the reception antenna is respectively 5 m and 10 m, a minimum distance between each antenna in a multiple antennas more than a predetermined distance may be required. For example, when the distance s between the transmission antenna and the reception antenna is 5 m, a required minimum distance between each antenna in a multiple antennas may be about 120 mm, and when the spacing s is 10 m, the required minimum distance between each antenna in a multiple antennas may be about 160 mm. Here, the required minimum distance between the antennas may be obtained when assuming that an arrangement of the multiple transmission antennas and an arrangement of the multiple reception antennas are parallel to each other while facing each other. Thus, when the two arrangements are not parallel to each other, a greater distance between each antenna in a multiple antennas may be required to obtain a maximum channel capacity. When the two arrangements are perpendicular to each other, the distance between the antennas may increase, or parallel channels that are spatially separated may not be obtained. That is, an advantage of the multiple antennas may not be utilized.

Figure 3:
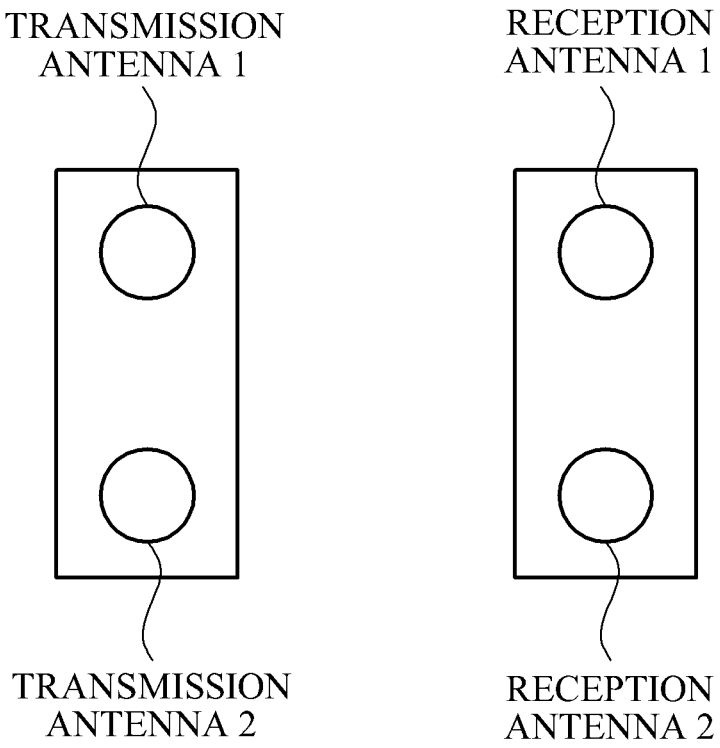
FIG. 3 is a diagram illustrating a case where a direction of two transmission antennas and a direction of two reception antennas are parallel to each other while facing each other.

FIG. 3 is a diagram illustrating a case where a direction of two transmission antennas and a direction of two reception antennas are parallel to each other while facing each other.

Referring to FIG. 3, it is assumed that each of two terminals desiring to perform a communication with each other has two antennas, arrangements of the antennas of the two terminals are parallel to each other while facing each other, and a distance between multiple antennas is appropriately determined to form a multi-antenna channel with a large channel capacity. In this case, results obtained when each of the above described two terminals is rotated will be herein described in detail.

Figure 4:
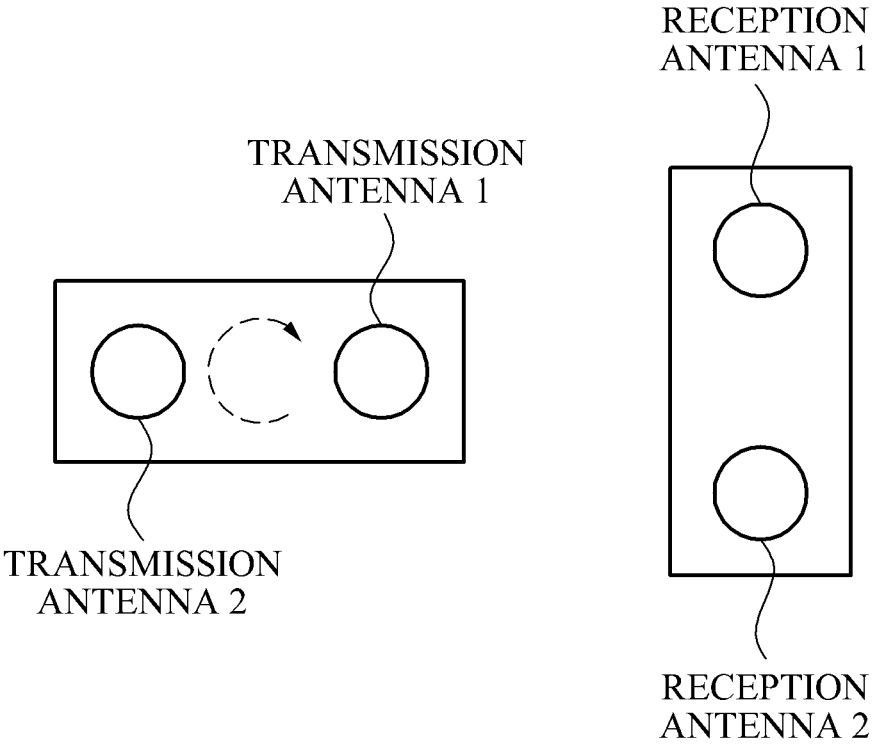
FIG. 4 is a diagram illustrating a case where multiple antennas are not effectively operated due to a rotation of a transmitter.

FIG. 4 is a diagram illustrating a case where multiple antennas are not effectively operated due to a rotation of a transmitter.

Referring to FIG. 4, the transmitter is rotated by 90 degrees in a clockwise direction, so that an arrangement of multiple antennas of the transmitter and an arrangement of multiple antennas of the receiver are perpendicular to each other. In this case, parallel channels that are spatially separated from each other even when using the multiple antennas may not be created. That is, a maximum channel capacity may not be obtained.

The reason the maximum channel capacity is not obtained may be because a distance from a transmission antenna 1 to a reception antenna 1 and a distance from the transmission antenna 1 to a reception antenna 2 are the same, and a distance from a transmission antenna 2 to the reception antenna 1 and a distance from the transmission antenna 2 to the reception antenna 2 are the same. That is, when each of the reception antenna 1 and the reception antenna 2 receives signals transmitted from the transmission antenna 1 or the transmission antenna 2, a phase difference does not occur.

Accordingly, to prevent arrangements of multiple antennas of respective terminals from being perpendicular to each other when the terminal is rotated by 90 degrees, a method where antennas are combined and a method where a rotation of the terminal is considered in advance when arranging antennas may be suggested. These two methods will be herein described in detail.

Figure 5:
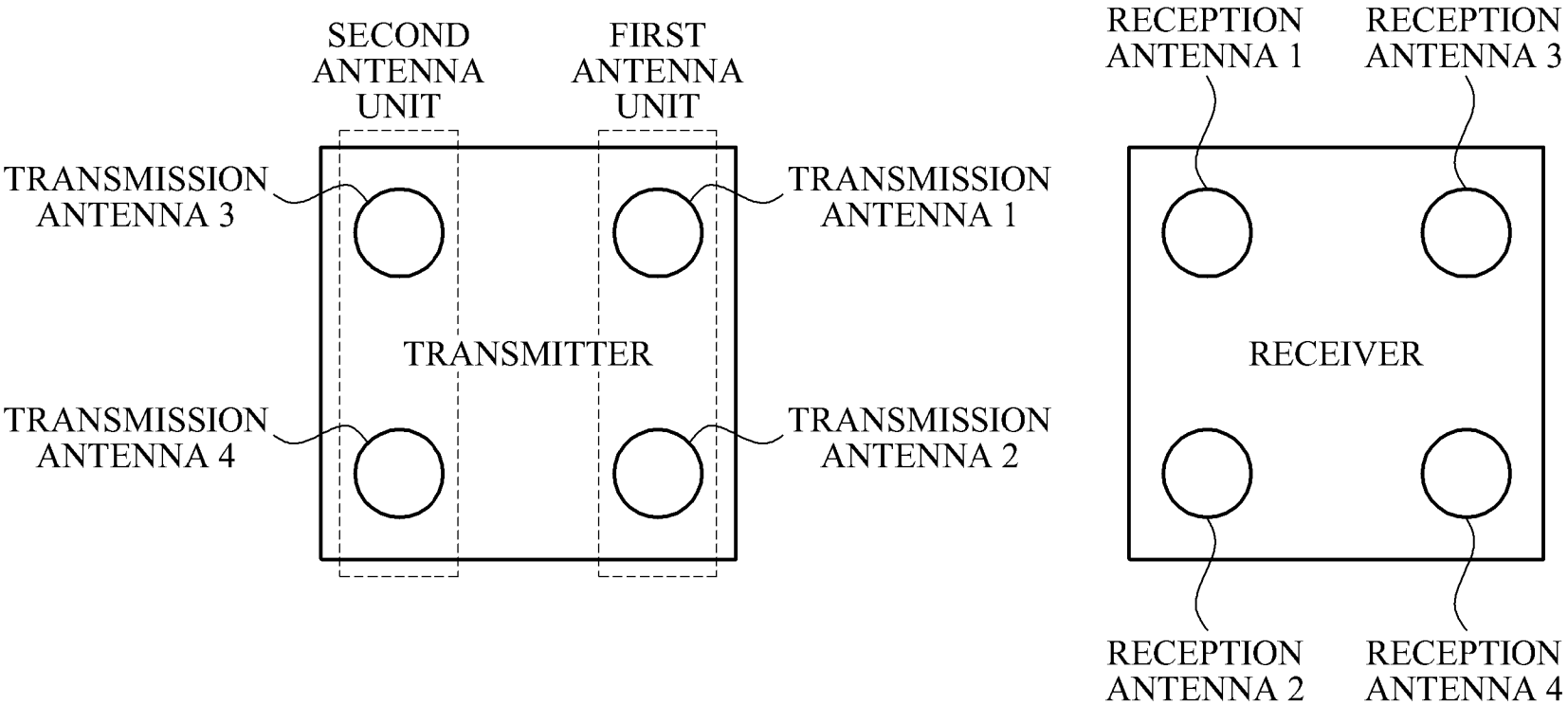
FIG. 5 is a diagram illustrating an example of an arrangement of multiple antennas according to an embodiment.

FIG. 5 is a diagram illustrating an example of an arrangement of multiple antennas according to an embodiment.

In FIG. 5, a transmitter includes a first antenna unit and a second antenna unit.

The first antenna unit may be disposed parallel to an arrangement of multiple antennas of a receiver while facing the arrangement of the multiple antennas of the receiver. Here, being parallel to the arrangement of the multiple antennas may denote being parallel to an imaginary line connecting the multiple antennas. Also, a transmission antenna and a reception antenna facing each other may denote that an arrangement of multiple transmission antennas and an arrangement of multiple reception antennas are parallel to each other, while the respective transmission antennas and the respective reception antennas have a one-to-one symmetry and the transmission antennas are positioned in front of the reception antennas. For example, when the reception antennas are not positioned in front of the transmission antenna even though the arrangement of the transmission antennas and the arrangement of the reception antennas are parallel to each other, the transmission antennas and the reception antennas may not face each other. For example, since the transmission antennas 1 and 2 are parallel to a line connecting the reception antennas 1 and 2, and have a one-to-one symmetry with the reception antennas 1 and 2 while being positioned in front of the reception antennas 1 and 2, results in the transmission antennas 1 and 2 and the reception antennas 1 and 2 to be disposed parallel to each other while facing each other.

The second antenna unit may be additionally disposed considering a rotation of the transmitter, so that an arrangement of transmission antennas and an arrangement of the reception antennas are parallel to each other while facing each other. Taking the rotation of the transmitter into account, antennas may be additionally disposed by predicting a result obtained when the transmitter is rotated, so that the arrangement of the reception antennas and the arrangement of the transmission antennas are parallel to each other while facing each other. For example, when the transmitter where the first antenna unit is disposed is rotated by 90 degrees in a clockwise direction, the arrangement of the transmission antennas and the arrangement of the receivers are perpendicular to each other, resulting in failing to realize a performance of the multiple antennas. Accordingly, even when the transmitter is rotated by 90 degrees in the clockwise direction, the transmission antennas may be additionally disposed so that the arrangement of the transmission antennas and the arrangement of the reception antennas are still parallel to each other while facing each other. Consequently, the transmission antennas may be additionally disposed so that a part of the arrangement of the transmission antennas and a part of the arrangement of the reception antennas are parallel to each other while facing each other.

The first antenna unit including the transmission antennas 1 and 2 and the second antenna unit including the transmission antennas 3 and 4 may be merely an example, and thus at least two antennas may be included in multiple antennas.

Also, in the transmitter according to an embodiment, the second antenna unit may be additionally disposed so that the arrangement of the transmission antennas and the arrangement of the reception antennas are parallel to each other while facing each other even when the receiver is rotated as well as when the receiver is fixed.

Also, the method of disposing multiple antennas according to an embodiment may be applied to a method where antennas are additionally disposed in the transmitter based on a rotation of the transmitter and a method where antennas are additionally disposed in the receiver based on a rotation of the receiver.

Also, the method of disposing the multiple antennas according to an embodiment may additionally dispose the reception antennas so that the arrangement of the reception antennas and the arrangement of the transmission antennas may be parallel to each other while facing each other even when the transmitter is rotated as well as when the transmitter is fixed.

Referring to FIG. 5, the method of disposing the multiple antennas according to an embodiment may use additional antennas to prevent an arrangement of antennas from being formed in an undesired direction when a terminal is rotated. First, the method of disposing the multiple antennas according to an embodiment may dispose the transmission antennas 1 and 2 in such a way that an arrangement of the transmission antennas 1 and 2 and an arrangement of the reception antennas 1 and 2 are parallel to each other. Next, the method of disposing the multiple antennas according to an embodiment may additionally dispose the transmission antennas 3 and 4 based on a rotation of the transmitter in such a way that the arrangement of the transmission antennas and the arrangement of the reception antennas are parallel to each other while facing each other.

Figure 6:
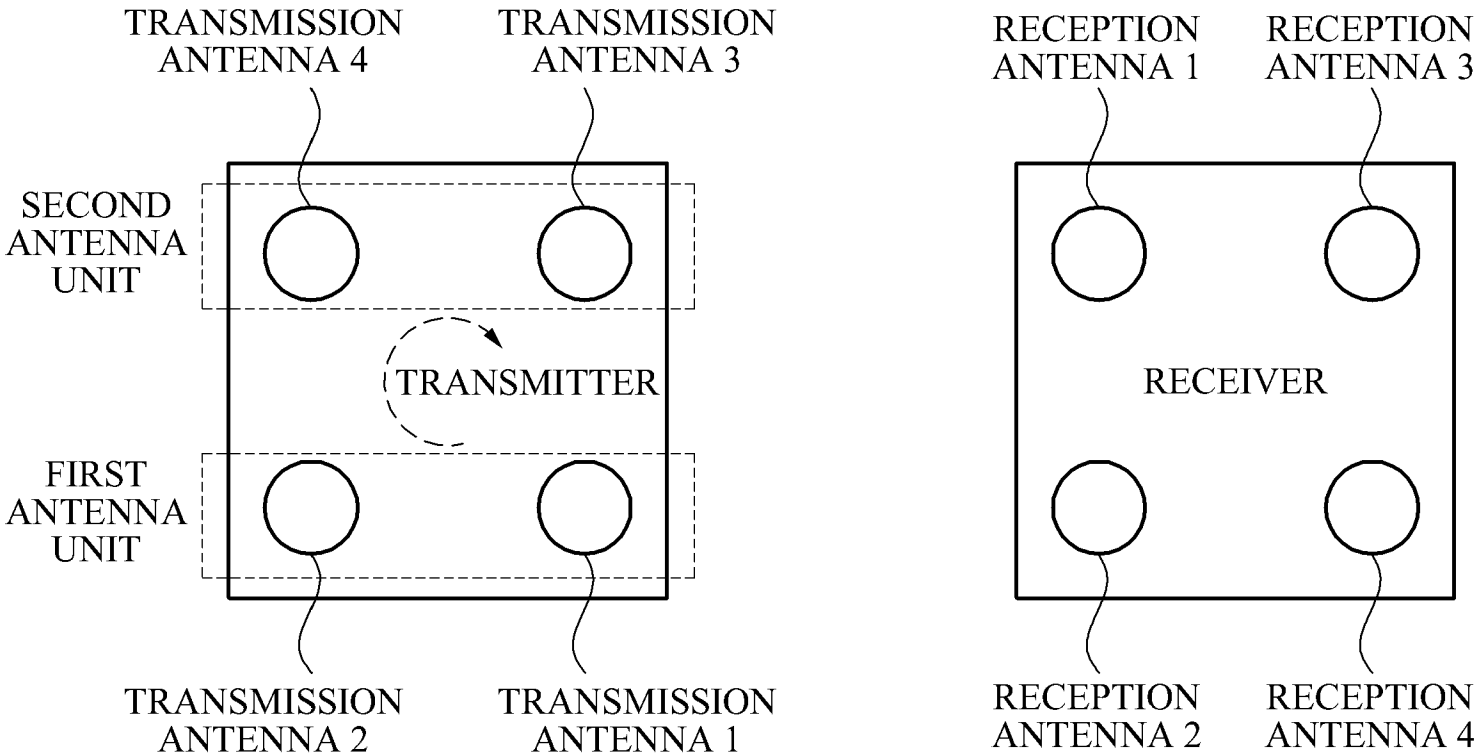
FIG. 6 is a diagram illustrating a case where a performance of multiple antennas is maintained even when a transmitter is rotated.

FIG. 6 is a diagram illustrating a case where a performance of multiple antennas is maintained even when a transmitter is rotated.

Referring to FIG. 6, in the transmitter according to an embodiment, a second antenna unit may be additionally disposed in the first antenna unit of FIG. 5. Even when the transmitter is rotated by 90 degrees in a clockwise direction, an arrangement of transmission antennas that are parallel to an arrangement of reception antennas 1 and 2 while facing the arrangement of the reception antennas 1 and 2 may be maintained. The additionally disposed second antenna unit may be used for obtaining a maximum channel capacity through multiple antennas when the transmitter or the receiver is rotated by 90 degrees. Also, The additionally disposed second antenna unit may not be used for obtaining an optimal channel capacity when a terminal is rotated by an arbitrary angle different from 90 degrees.

Accordingly, even when the terminal is rotated by the arbitrary angle, a method for obtaining a maximum channel capacity may be required, which will be herein described.

Figure 7:
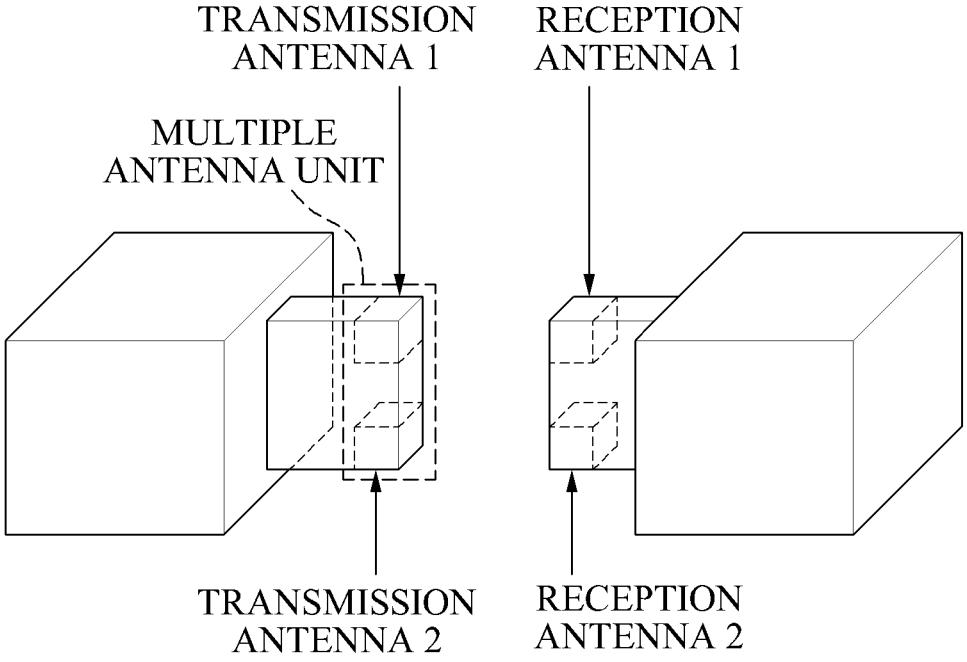
FIG. 7 is a diagram illustrating an arrangement of multiple antennas based on relation with a plane where a terminal is positioned according to an embodiment.

FIG. 7 is a diagram illustrating an arrangement of multiple antennas based on a relation with a plane where a terminal is positioned according to an embodiment.

Referring to FIG. 7, a transmitter according to an embodiment includes a multiple antenna unit and a transmission unit.

The multiple antenna unit may be disposed in such a way that an imaginary line connecting arrangements of multiple antennas positioned in the transmitter and a receiver is perpendicular to a plane where the transmitter is positioned.

In the transmission unit, a signal to be transmitted through multiple antennas may be inputted and processed.

Also, the multiple antenna unit may be disposed in such a way that a plane comprising an imaginary line connecting an arrangement of multiple antennas of the transmitter and an imaginary line connecting an arrangement of multiple antennas of the receiver may be perpendicular to a reflection plane where a signal transmitted through the transmitter is reflected. For example, when the signal transmitted from the transmitter meets the reflection plane to be reflected while proceeding, the multiple antenna unit may dispose antennas in such a way that a plane comprising an imaginary line connecting two transmission antennas and an imaginary line connecting two reception antennas is perpendicular to the reflection plane. An improvement of communication performance through multiple antennas in a case where the reflection plane is present will be described with reference to FIGS. 9 and 10.

Also, the method of disposing the multiple antennas according to an embodiment may dispose antennas in such a way that a plane where a terminal is positioned is perpendicular to an imaginary line connecting an arrangement of the antennas. Specifically, the antennas may be disposed in such a way that a normal vector of the plane where the terminal is positioned is parallel to the imaginary line connecting the arrangement of the antennas.

Accordingly, the method of disposing the multiple antennas according to an embodiment may dispose transmission antennas in such a way that a plane where a transmitter is positioned is perpendicular to each of an imaginary line connecting an arrangement of multiple antennas of the transmitter and an imaginary line connecting an arrangement of multiple antennas of the receiver, so that the arrangement of the multiple antennas of the transmitter and the arrangement of the multiple antennas of the receiver may be parallel to each other while facing each other.

Also, the method of disposing the multiple antennas according to an embodiment may dispose reception antennas in such a way that a plane where the receiver is positioned is perpendicular to each of the imaginary line connecting the arrangement of the multiple antennas of the transmitter and the imaginary line connecting the arrangement of the multiple antennas of the receiver, so that the arrangement of the multiple antennas of the transmitter and the arrangement of the multiple antennas of the receiver may be parallel to each other while facing each other.

Also, the method of disposing the multiple antennas according to an embodiment may dispose the transmission antennas or the reception antennas in such a way that the plane comprising the imaginary line connecting the arrangement of the multiple antennas of the transmitter and the imaginary line connecting the arrangement of the multiple antennas of the receiver is perpendicular to the reflection plane where the signal transmitted through the transmitter is reflected. An improvement of communication performance through multiple antennas in a case where the reflection plane is present will be described with reference to FIGS. 9 and 10.

Figure 8:
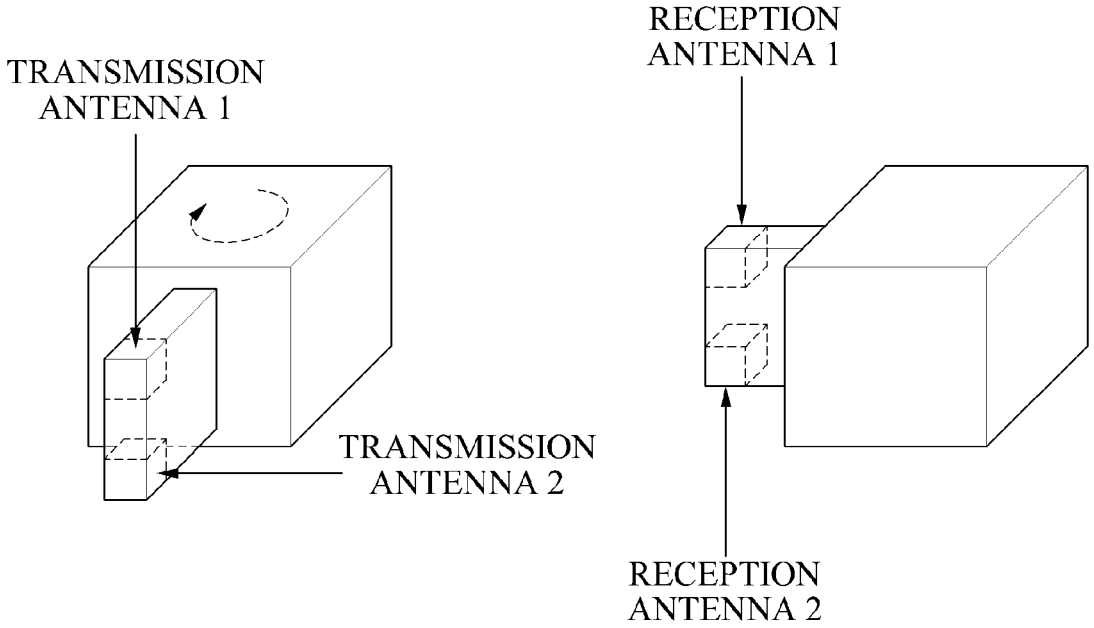
FIG. 8 is a diagram illustrating a case where a performance of multiple antennas is maintained even when a transmitter of FIG. 7 is rotated.

FIG. 8 is a diagram illustrating a case where a performance of multiple antennas is maintained even when a transmitter of FIG. 7 is rotated.

Referring to FIG. 8, when the transmitter of FIG. 7 is rotated in a clockwise direction, an arrangement of multiple antennas of the transmitter and an arrangement of multiple antennas of the receiver may be maintained to be parallel to each other while facing each other.

Also, when the transmitter is rotated by an arbitrary angle on a plane where the transmitter is positioned, as well as when the transmitter is rotated by 90 degrees, an arrangement of transmission antennas and an arrangement of reception antennas may be maintained to be parallel to each other while facing each other, thereby acquiring a maximum channel capacity.

Figure 9:
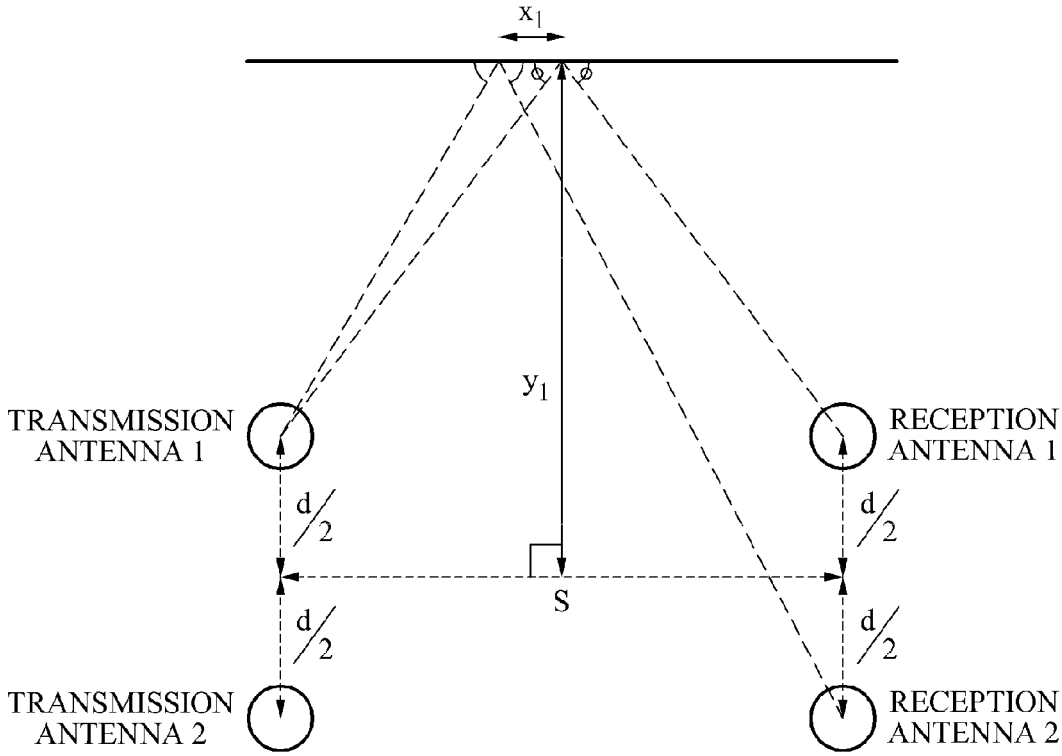
FIG. 9 is a diagram illustrating a multi-antenna channel including a reflection plane according to an embodiment.

FIG. 9 is a diagram illustrating a multi-antenna channel including a reflection plane according to an embodiment.

Referring to FIG. 9, the transmitter according to an embodiment may acquire a maximum channel capacity using multiple antennas when a reflected signal and a Line-of-Sight signal are present.

For example, in FIG. 9, it may be assumed that a channel including a single reflection plane is provided to take the reflected signal into account, and an arrangement of multiple antennas of the transmitter, that is, an arrangement of transmission antennas 1 and 2, and an arrangement of multiple antennas of the receiver, that is, an arrangement of reception antennas 1 and 2 are parallel to each other while facing each other. This assumption may be easily predicted based on a condition for acquiring the maximum channel capacity in a case of a channel where only a Line-of-Sight signal is present.

It may be assumed that the single reflection plane is spaced apart, by $y_1$, from an imaginary line connecting a center of the arrangement of the transmission antennas and a center of the arrangement of the reception antennas, and the reflection plane is perpendicular to each of the imaginary line connecting the arrangement of the multiple antennas of the transmitter and the imaginary line connecting the arrangement of the multiple antennas of the receiver.

In FIG. 9, a distance 'd' between the multiple antennas of each of the transmitter and the receiver may be 5 mm, and the distance $y_1$ to the reflection plane may be 2.5 m.

A phase difference between a signal transmitted from the transmission antenna 1 to the reception antenna 1 and a signal transmitted from the transmission antenna 1 to the reception antenna 2 may be $x_1$, so that a larger channel capacity may be acquired when using multiple antennas.

Figure 10:
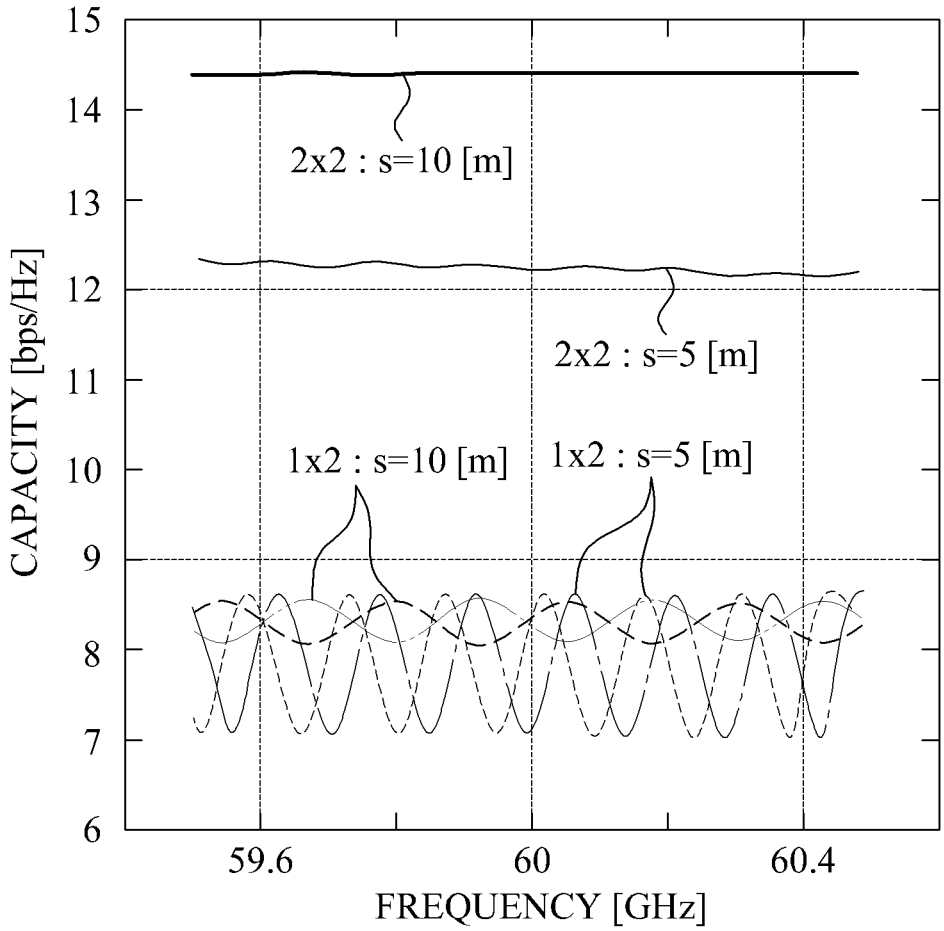
FIG. 10 is a graph illustrating a channel capacity varying depending on a frequency of FIG. 9.

FIG. 10 is a graph illustrating a channel capacity varying depending on a frequency of FIG. 9.

Referring to FIG. 10, a capacity of each of a channel (2×2) including transmission antennas 1 and 2 and reception antennas 1 and 2, a channel (1×2) including the transmission antenna 1 and the reception antennas 1 and 2, and a channel (1×2) including the transmission antenna 2 and the reception antennas 1 and 2 is illustrated in the graph.

Referring to FIG. 10, the capacity of the channel (2×2) may be a significantly larger than the capacity of the channel (1×2), which denotes that the channel (2×2) may acquire a channel capacity through two parallel channels that are spatially separated from each other.

In a case of the channel (1×2), two graphs including two cases where the transmission antenna 1 or 2 is present may be obtained.

When the reflection plane is present, a larger channel capacity may be obtained even using a smaller distance between the multiple antennas, in comparison with a case where only the Line-of-Sight path of FIG. 2 is present.

Accordingly, a reflection path where the signal is reflected may be used for reducing the distance between the multiple antennas to acquire a maximum channel capacity using the multiple antennas. Also, by using the reflection path, miniaturization of a terminal may be realized, and costs of the terminal may be effectively reduced.

Accordingly, in a case of a channel where the signal scattering phenomenon does not occur, the reflection plane may be used to obtain a distance between multiple antennas for ensuring a high performance of a communication technology through multiple antennas of each terminal.

Also, in a case of the channel where the signal scattering phenomenon does not occur, the method of disposing the multiple antennas for ensuring the high performance of the communication technology may dispose antennas in such a way that a plane where a terminal is positioned is perpendicular to a line connecting an arrangement of the antennas. Specifically, the method may dispose the antennas in such a way that a normal vector of the plane where the terminal is positioned is parallel to the line connecting the arrangement of the antennas.

The multiple antennas according to an embodiment may transmit a signal of a millimeter wave with a bandwidth of 60 GHz.

The methods according to the above-described embodiments may be recorded in computer-readable non-transitory storage media including program instructions to implement various operations embodied by a computer. The media may also include, alone or in combination with the program instructions, data files, data structures, and the like. Examples of computer-readable non-transitory media include magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like. Examples of program instructions include both machine code, such as produced by a compiler, and files containing higher level code that may be executed by the computer using an interpreter. The described hardware devices may be configured to act as one or more software modules in order to perform the operations of the above-described embodiments, or vice versa.

Although a few embodiments have been shown and described, it would be appreciated by those skilled in the art that changes may be made in these embodiments without departing from the principles and spirit of the disclosure, the scope of which is defined by the claims and their equivalents.

What is claimed is:

1. A transmission apparatus, comprising:

a first antenna unit to be disposed parallel to an arrangement of multiple antennas of a receiver while facing the arrangement of the multiple antennas of the receiver; and a second antenna unit where a transmission antenna is additionally disposed so that an arrangement of multiple antennas of a transmitter is parallel to the arrangement of the multiple antennas of the receiver while facing the arrangement of the multiple antennas of the receiver, when the transmitter is rotated.

2. The transmission apparatus of claim 1, wherein the arrangement of the multiple antennas positioned in the receiver is rotated, when the receiver is rotated.

3. A transmission apparatus, comprising:

a multiple antenna unit where a transmission antenna is disposed so that each of an imaginary line connecting an arrangement of multiple antennas disposed in a transmitter and an imaginary line connecting an arrangement of multiple antennas disposed in a receiver is perpendicular to a plane where the transmitter is disposed; and a transmission unit.

4. The transmission apparatus of claim 3, wherein, in the multiple antenna unit, a plane comprising the imaginary line connecting the arrangement of the multiple antennas of the transmitter and the imaginary line connecting the arrangement of the multiple antennas of the receiver is perpendicular to a reflection plane where a signal transmitted through the transmitter is reflected.

5. A method of disposing multiple antennas which additionally disposes a transmission antenna based on a case where a transmitter is rotated, so that an arrangement of multiple antennas disposed in the transmitter is parallel to an arrangement of multiple antennas of a receiver while facing the arrangement of the multiple antennas of the receiver.

6. The method of claim 5, wherein the arrangement of the multiple antennas disposed in the receiver is rotated while the receiver is rotated.

7. A method of disposing multiple antennas which additionally disposes a reception antenna based on a case where a receiver is rotated, so that an arrangement of multiple antennas disposed in the receiver is parallel to an arrangement of multiple antennas of a transmitter while facing the arrangement of the multiple antennas of the transmitter.

8. The method of claim 7, wherein the arrangement of the multiple antennas disposed in the transmitter is rotated while the transmitter is rotated.

9. A method of disposing multiple antennas, comprising:

disposing a transmission antenna so that each of an imaginary line connecting an arrangement of multiple antennas of a transmitter and an imaginary line connecting an arrangement of multiple antennas of a receiver is perpendicular to a plane where the transmitter is disposed.

10. The method of claim 9, further comprising:

disposing the transmission antenna so that a plane comprising the imaginary line connecting the arrangement of the multiple antennas of the transmitter and the imaginary line connecting the arrangement of the multiple antennas of the receiver is perpendicular to a reflection plane where a signal transmitted through the transmitter is reflected.

11. A method of disposing multiple antennas which disposes a reception antenna so that an imaginary line connecting an arrangement of multiple antennas of a receiver and an imaginary line connecting an arrangement of multiple antennas of a transmitter is perpendicular to a plane where the receiver is disposed.

12. The method of claim 11, further comprising:

disposing the reception antenna so that a plane comprising the imaginary line connecting the arrangement of the multiple antennas of the receiver and the imaginary line connecting the arrangement of the multiple antennas of the transmitter is perpendicular to a reflection plane where a signal received through the receiver is reflected.

* * * * *

UNITED STATES PATENT AND TRADEMARK OFFICE

CERTIFICATE OF CORRECTION

PATENT NO. : 8,456,377 B2
APPLICATION NO. : 12/939739
DATED : June 4, 2013
INVENTOR(S) : Mun Geon Kyeong et al.

It is certified that error appears in the above-identified patent and that said Letters Patent is hereby corrected as shown below:

On the Title page, Item 30, under the heading Foreign Application Priority Data, before "Apr. 19, 2010 (KR) ..... 10-2010-0035877" insert the following:

--Nov. 4, 2009 (KR) ..... 10-2009-0106003--

Signed and Sealed this
Thirtieth Day of July, 2013

Teresa Stanek Rea

Teresa Stanek Rea
*Acting Director of the United States Patent and Trademark Office*